United States Patent [19]

Fenoglio et al.

[11] Patent Number: 4,571,368

[45] Date of Patent: Feb. 18, 1986

[54] ALUMINUM AND ZINC SACRIFICIAL ALLOY

[75] Inventors: John C. Fenoglio, Clinton; David L. Wilbur, West Terre Haute, both of Ind.; William H. Anthony, Bartlett, Ill.

[73] Assignee: Atlantic Richfield Company, Denver, Colo.

[21] Appl. No.: 627,403

[22] Filed: Jul. 3, 1984

Related U.S. Application Data

[63] Continuation-in-part of Ser. No. 458,255, Jan. 17, 1983, abandoned.

[51] Int. Cl.[4] ..... B32B 15/20; C22C 21/02

[52] U.S. Cl. ..... 428/654; 420/532; 420/534; 420/537; 420/538; 420/546; 420/547; 420/548; 420/550; 204/147; 204/293

[58] Field of Search ..... 420/532, 534, 537, 538, 420/541, 546, 547, 548, 549, 550; 428/654; 204/147, 148, 248, 293

[56] References Cited

U.S. PATENT DOCUMENTS

| | | | |
|---|---|---|---|
| 1,871,607 | 8/1932 | Hall et al. | 420/535 |
| 2,290,025 | 7/1942 | Bansack | 420/532 |
| 2,354,006 | 7/1944 | Gauthier | 420/532 |
| 2,913,384 | 11/1959 | Staley | 204/148 |
| 3,168,381 | 2/1965 | Finnegan et al. | 428/654 |
| 3,418,230 | 12/1968 | Rutemiller | 204/148 |
| 3,421,990 | 1/1969 | Penix | 204/148 |
| 3,674,448 | 7/1972 | Brown et al. | 428/654 |
| 3,818,566 | 6/1974 | Anderson et al. | 428/629 |
| 4,169,728 | 10/1979 | Takeuchi et al. | 420/532 |
| 4,235,628 | 11/1980 | Althoff et al. | 420/534 |
| 4,238,233 | 12/1980 | Yamada et al. | 420/541 |

*Primary Examiner*—L. Dewayne Rutledge
*Assistant Examiner*—Robert L. McDowell
*Attorney, Agent, or Firm*—Allegretti, Newitt, Witcoff & McAndrews, Ltd.

[57] ABSTRACT

An improved aluminum base alloy which provides corrosion protection in fin stock applications includes 0.6–3.0% silicon; 0.2–1.0% by weight iron; up to 0.2% by weight copper; 0.8–2.0% by weight manganese; up to 0.2% by weight magnesium; from about 0.5% by weight zinc to 2.5% by weight zinc; up to 0.2% by weight other constituents; and the balance aluminum. The alloy is especially useful as a sacrificial alloy having improved mechanical strength.

9 Claims, 13 Drawing Figures

Galvanic Tests on Terre Haute Produced Materials

Galvanic Tests on
Control Materials

Plot of Core Alloy Corrosion Versus Clad Alloy Corrosion

Galvanic Test on Experimental 0.86% Zinc Alloy

Galvanic Test on Experimenal 1.16% Zinc Alloy
Average of Two Data Points

Galvanic Test on Experimental 1.38% Zinc Alloy
Averages to Two Data Points

Galvanic Test on Experimental 2.0% Zinc Alloy
Averages of Two Data Points

Galvanic Test on Experimental 2.48% Zinc Alloy

Galvanic Test on 7072 Alloy

Galvanic Test on 8007 Alloy

Photograph of Anode Alloy Specimens After Exposure to Galvanic Test

ALUMINUM AND ZINC SACRIFICIAL ALLOY

CROSS REFERENCE TO RELATED APPLICATION

This is a continuation-in-part of application Ser. No. 458,255, filed Jan. 17, 1983, now abandoned.

BACKGROUND OF THE INVENTION

This invention relates to an improved aluminum alloy composition which is a sacrificial alloy especially useful for the fabrication of fin stock attached to aluminum tubing.

The use of galvanic anodes of aluminum, magnesium or zinc are known. Anode materials have, in the past, been used to protect pipe covered by soil, the hulls of ships in sea water, off shore oil well platform structures, and for many other applications.

Cathodic protection of aluminum materials is effected in a similar fashion. For example, the item being protected may be covered by a cladding or layer of sacrificial material. Thus, an aluminum alloy core may be clad with a sacrificial layer of aluminum or another aluminum alloy in order to provide cathodic protection. The core then provides the desired mechanical properties for the article whereas the cladding will provide appropriate cathodic protection.

Aluminum tubing is often used for heat exchangers. The tubing may be exposed to corrosive atmospheres or may carry materials which may be corrosive. In order to inhibit this corrosion, one must use some type of cathodic protection device. The present invention relates to an improved aluminum alloy useful in providing sacrificial cathodic protection particularly in combination with aluminum tubing, for example, in a heat exchanger.

SUMMARY OF THE INVENTION

Briefly, the present invention relates to an improved aluminum base alloy which includes a zinc constituent and which is especially useful as a sacrificial alloy. The alloy has application as a fin stock material for use in combination with aluminum tubing. The alloy composition provides a material which has mechanical strength as well as sacrificial alloy characteristics. The alloy consists essentially of small amounts of silicon, iron, copper, manganese, magnesium, 0.5 up to 2.5% by weight zinc and minor amounts of other constituents with the balance being aluminum. Preferably the alloy comprises no less than 1% by weight and no greater than 2% by weight zinc. The alloy material may be formed as fin stock and affixed mechanically to aluminum tubing. The fin stock will then sacrificially decompose protecting the aluminum tubing from pitting or otherwise deteriorating. Moreover, the fin stock has excellent mechanical strength thereby eliminating the need for a mechanically stronger core material to construct heat exchanger fins.

Thus, it is an object of the invention to provide an improved alloy which may be used as a cathodic protection alloy.

A further object of the present invention is to provide an improved aluminum base alloy which may be used in combination with aluminum tubing as fin stock material.

A further object of the present invention is to provide an improved aluminum base cathodic protection alloy which has sufficient mechanical strength and eliminates the need for a core material for fin stock and other applications.

These and other objects, advantages and features of the invention will be set forth in the detailed description which follows.

BRIEF DESCRIPTION OF THE DRAWINGS

In the detailed description which follows, reference will be made to the drawing comprised of the following figures.

DESCRIPTION OF THE PREFERRED EMBODIMENT

Figure 1:
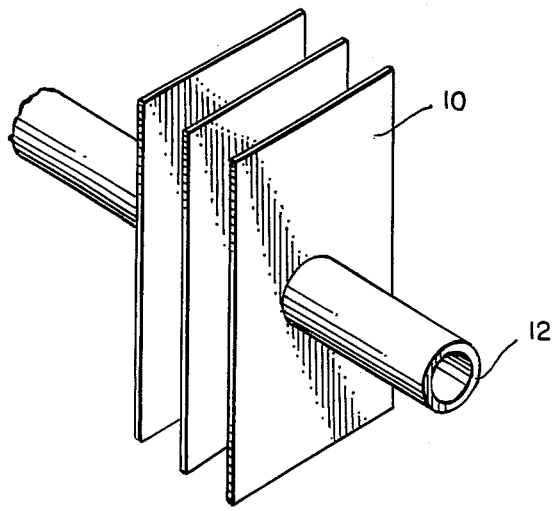
FIG. 1 is a perspective view of a portion of a typical aluminum tube, heat exchanger having a plurality of fins made from the improved alloy of the invention attached to the aluminum tubing.

The present invention constitutes a specific aluminum base alloy which includes a zinc constituent. The alloy is especially useful in the formation of fin stock because of its mechanical characteristics and also serves as a sacrificial cathodic protection material. That is, the alloy may be formed in thin sheets as fin material such as fin 10 in FIG. 1. The fin 10 has sufficient mechanical strength to retain its formed shape. The fin 10 is mechanically affixed to a tube 12. Typically the tube 12 is also an aluminum base alloy material for which the fin 10 will provide cathodic protection.

Generally, the aluminum base alloy of the present invention has the following composition limits in weight precent:

| Silicon (Si) | Iron (Fe) | Copper (Cu) | Manganese (Mn) |
|---|---|---|---|
| 0.6–3.0 | 0.2–1.0 | 0.2 max. | 0.8–2.0 |
| **Magnesium (Mg)** | **Zinc (Zn)** | **Others (Total)** | **Aluminum (Al)** |
| 0.2 max. | 0.50–2.50 | 0.2 max. | balance |

The above identified alloy is an improvement upon the prior art alloy having the registration record number 3009 set forth in the registration record of international alloy designations and chemical composition limits for wrought aluminum and wrought aluminum alloys revised June 1, 1980. The alloy of the present invention differs from the known prior art 3009 alloy by the addition and inclusion of a measured amount of zinc. As a result of the inclusion of the measured amount of zinc, the alloy of the present invention provides sacrificial corrosion characteristics which are not found in the noted prior composition and, importantly, also has superior strength and formability characteristics particularly as compared with other sacrificial alloys.

Other alloys which have sacrificial corrosion characteristics have the identification or record registration number 7072 which has had an international registration since July 1, 1954 and number 8007. The nominal composition of the 7072 alloy in weight percent follows:

| Silicon (Si) + Iron (Fe) | | Copper (Cu) | Manganese (Mn) |
|---|---|---|---|
| 0.7 | | 0.10 | 0.10 |
| Magnesium (Mg) | Zinc (Zn) | Others (Total) | Aluminum (Al) |
| 0.10 | 0.8–1.3 | 0.15 | balance |

The 7072 composition alloy is often used as cladding to provide sacrificial corrosion protection to the center or core of a clad sheet. It is also used with aluminum alloy tube for fin stock in heat exchangers.

The nominal composition of the 8007 alloy in weight percent follows:

| Silicon (Si) | Iron (Fe) | Copper (Cu) | Manganese (Mn) |
|---|---|---|---|
| 0.4 | 1.2–2.0 | 0.1 max. | 0.3–1.0 |
| Magnesium (Mg) | Chromium (Cr) | Zinc (Zn) | Titanium (Ti) |
| 0.1 max. | 0.05% max. | 0.8–1.8 | not available |

The general characteristics of such alloys are discussed at pages 251–252 of the American Society for Metals Book entitled "Aluminum-Volume 1".

The present alloy differs from the prior art 7072 alloy because the amount of silicon plus iron in the present alloy exceeds the amount specified for the 7072 alloy; namely, 0.7 weight percent. Additionally, the limits on the other constituents are different. For example, the manganese constituent is different. The present alloy also differs from the 8007 alloy in its constituent limits of manganese and silicon, for example.

More importantly, the alloy of the present invention has superior strength and formability characteristics, especially relative to the 7072 and 8007 alloys, and also has the capability to provide sacrificial protection without loss of strength and formability characteristics. Much of this was demonstrated by a series of tests described as follows:

EXAMPLES

Background and Procedure

The starting point in the processing sequence was preparation of a series of test samples. Initially a base alloy similar to a 3009 alloy was prepared. The base alloy included zinc in addition to other constituents of a 3009 alloy. The composition range of the base alloy cast material was determined by analyzing three different sample sections as follows:

| Percentage Element (wt. %) | | | | | | | | |
|---|---|---|---|---|---|---|---|---|
| Si | Fe | Cu | Mn | Mg | Cr | Zn | Ti | B |
| 1.15 to 1.16 | 0.46 to 0.47 | 0.09 | 1.01 to 1.05 | 0.036 to 0.046 | 0.004 | 0.036 to 0.038 | 0.020 to 0.031 | 0.004 to 0.005 |

Casting was carried out in non-preheated copper molds having a square section with an edge length of 1.625 inches.

Slices of cast alloy were cut and melted in a crucible. Zinc was then added as compact pieces of high purity zinc when the melt temperatured was 1298° F. The melt was poured into the molds at a temperature of 1400° F. The compositions of the castings were the same as the base alloy, except for the zinc concentrations which were as follows in weight percent: 0.045%; 0.24%; 0.59%; 0.86%; 1.16%; 2.0%; 2.47%.

The cast materials were homogenized in a Lindberg Temperite Furnace equipped with a Honeywell Digital Control programmer. The temperature profile of the homogenization practice was designed to provide complete homogenization of the microconstituents soluble at 1100° F., and to subsequently coarsen the eutectic particles. Hot rolling and cold rolling were carried out in accordance with a typical process for mechanical joint finstock.

Figure 2:
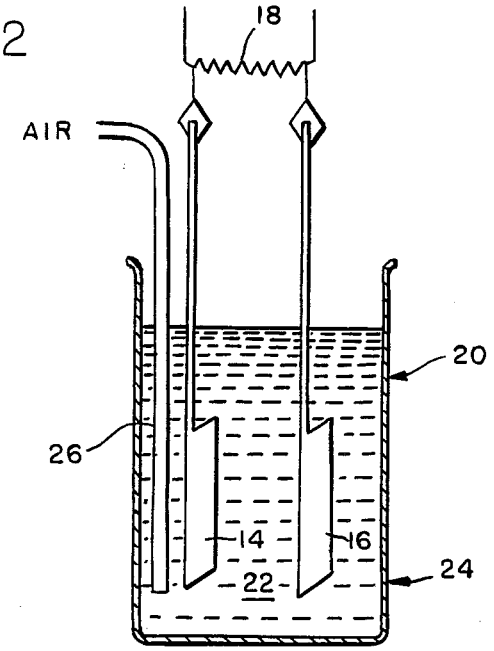
FIG. 2 is a schematic view of a test configuration for testing the improved alloy invention.

A sheet specimen of each of the test alloys (i.e. 3009, 7072, 8007 and the new alloys with zinc) was weighed on a sensitive chemical balance to an accuracy of ±0.1 milligrams and was then coated on its edges with a water impermeable lacquer, leaving a total area unlacquered of 14.5 sq. centimeters (counting both sides of the specimen). Each specimen 14 in FIG. 2 was then electrically connected, via alligator clamps and 10 ohm resistors 18, to a similar weighed and lacquered specimen 16 of an alloy 1235 sheet. Alloy 1235 is a known alloy for making aluminum tubing used in heat exchangers. Nominal chemical analysis for the 1235 alloy in weight percent is as follows:

| Silicon | Copper | Manganese |
|---|---|---|
| 0.65 Si + Fe Max. | 0.05 Max. | 0.05 Max. |
| Magnesium | Zinc | Titanium |
| 0.05 Max. | 0.1 Max. | 0.06 Max. |

From the voltage measured across the 10 ohm resistor 18, the current in milliamperes in each galvanic cell 20 could be measured once a conductive corrosive solution 22 was introduced into the beaker 24.

The solution used was a 5% solution of sodium chloride in distilled water, adjusted to a pH of 3.1 to 3.3 with glacial acetic acid. Cells 20 for each pair of electrodes were placed in a thermostated water bath held at 35° C. Air was bubbled through a tube 26 in each cell 20 to provide a realistic simulation of actual service conditions to which might be encountered with an actual heat exchanger core.

Galvanic Test Results

Figure 3:
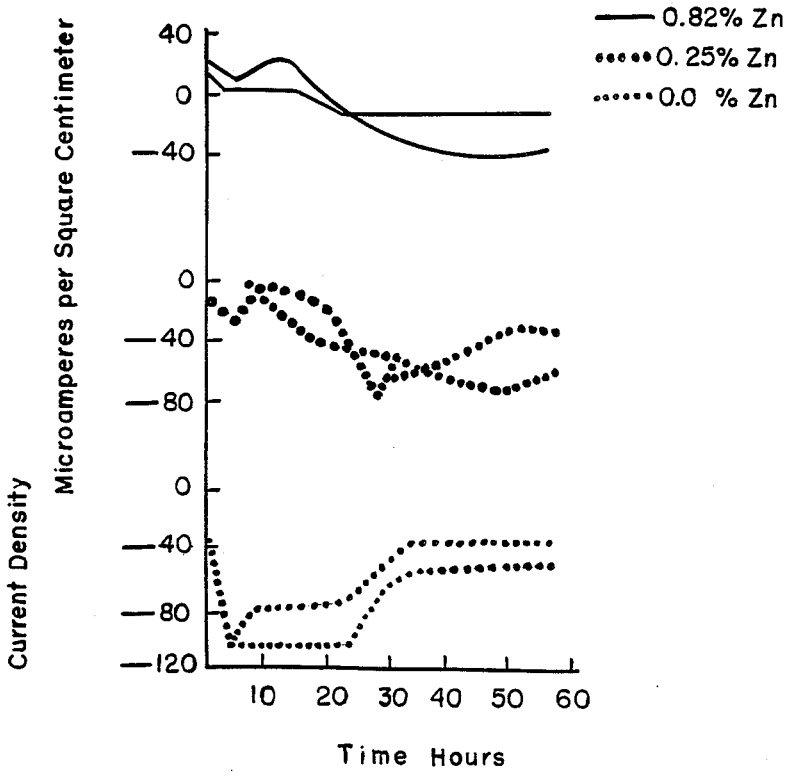
FIG. 3 is a graph of current density versus time.

FIG. 3 shows a series of three plots of galvanic current flow (in microamperes per square centimeter) plotted against time of exposure for couples of 1235 tube alloy (nominally considered the cathode) against the 3009 alloy and the new alloy with zinc specimens, i.e.

specimens containing zero, 0.25% and 0.82% of zinc. The direction of galvanic current flow is shown as a negative quantity if, in fact, the alloy material is the cathode and the 1235 tube alloy is the anode. The results shown represent duplicate runs. The results show that both the zero percent zinc material and the 0.25% zinc material behave as cathodes throughout the test run of 60 hours. The 0.82% zinc material behaves as an anode offering sacrificial protection to the 1235 alloy tube for the first 10 of the 60 hours of the test run.

Figure 4:
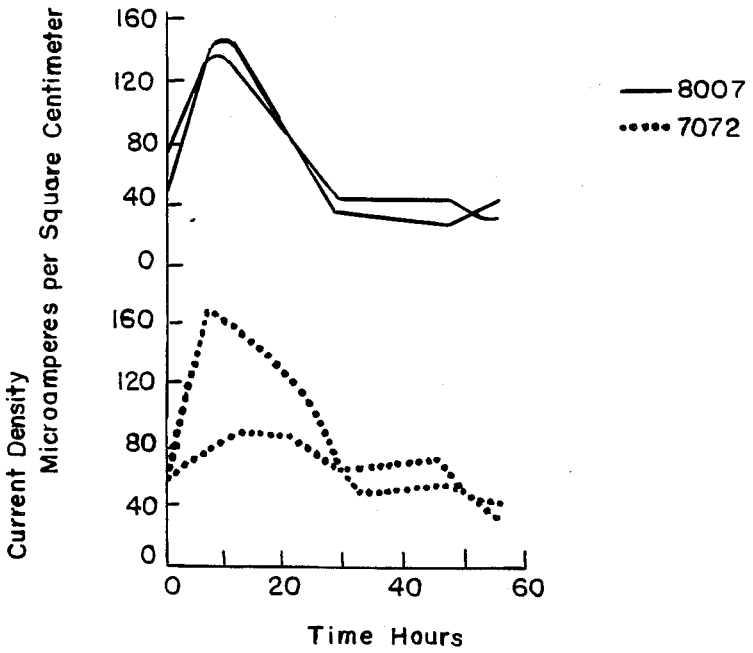
FIG. 4 is a graph of current density versus time.

FIG. 4 shows a plot of analogous data for 8007 and 7072 alloy sheet, also coupled to 1235 alloy tube. The data indicate that both materials provide sacrificial protection to the 1235 alloy tubes with current densities which vary a great deal in the initial 30 hours of testing, but settle down to the range of 40 to 60 microamperes per square centimeter of electrode surface in the last 30 hours of test.

Galvanic Corrosion Test

In this test, the weight loss rate on anode and cathode sheet specimens was determined when they were coupled through a 10 ohm resistor and allowed to stand in an aerated 5% sodium chloride solution adjusted to pH 3.3 with acetic acid. The temperature of the solution was thermostatically maintained at 35° C. The magnitude and direction of the galvanic current flow between the specimens was monitored by measuring the voltage drop across the resistor with a Keithley electrometer. The electrode potentials were also measured on the couples when connected together through the resistor and after separating them to measure the freely corroding individual potentials. The reference electrode used in all measurements was a saturated calomel electrode (SCE).

When the test was complete after a specified period of hours, the corrosion product was removed by immersing the specimens in a cleaning solution consisting of 20 grams chromic acid, 50 ml. of phosphoric acid (specify gravity of 1.69), made up to 1 liter with distilled water. The temperature of this test solution was adjusted to 80° C. The immersion time was 5 to 10 minutes.

Figure 5:
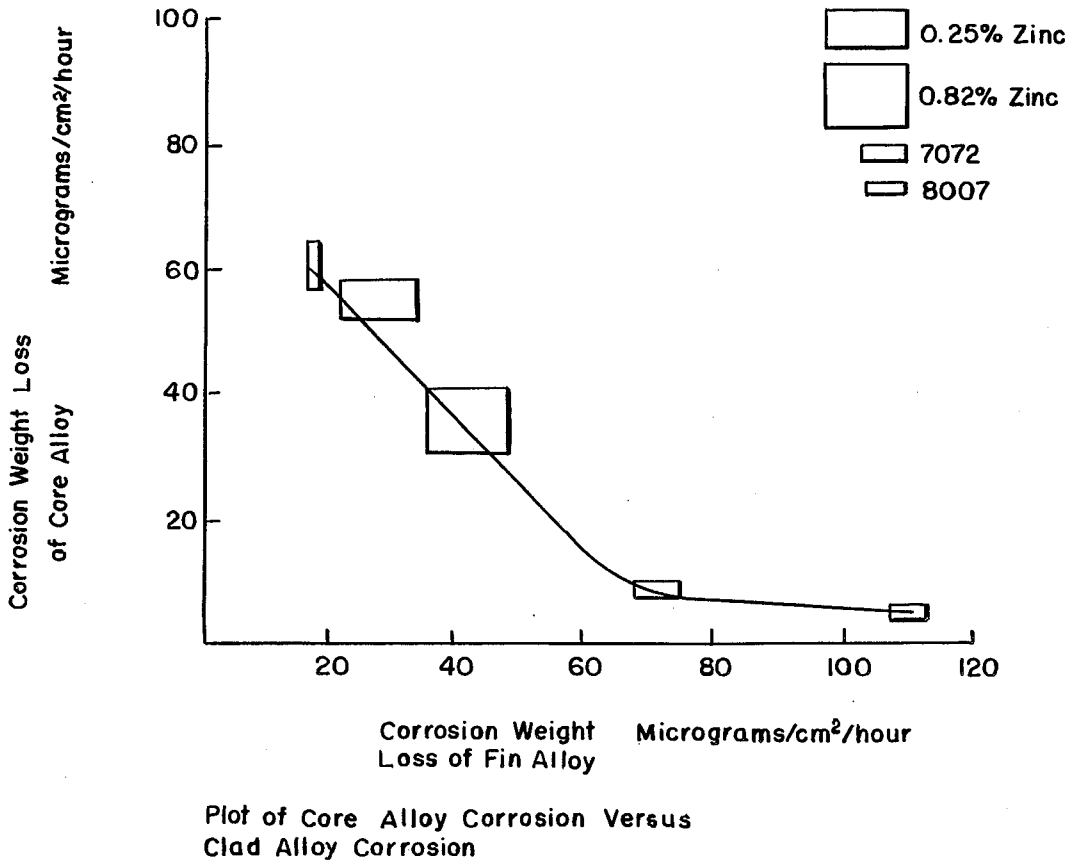
FIG. 5 is a graph of weight loss of core alloy versus weight loss of fin alloy.

FIG. 5 shows a plot of the weight loss sustained by the various candidate finstock materials. The rectangular shapes have edge lengths which define the spread between the duplicate weight loss measurements. The vertical edges represent spreads in tube alloy weights, whereas the horizontal edges represent spreads between the fin alloy weight losses.

This graphical representation underlines the fact that the tube alloy weight losses are low when coupled fin alloy is either 7072 or 8007, and is large when the fin material is the 3009 alloy with zero and 0.25% zinc. The 7072 and 8007 are protective whilst the 3009 alloy is not.

Further Galvanic Test Results

Figure 6:
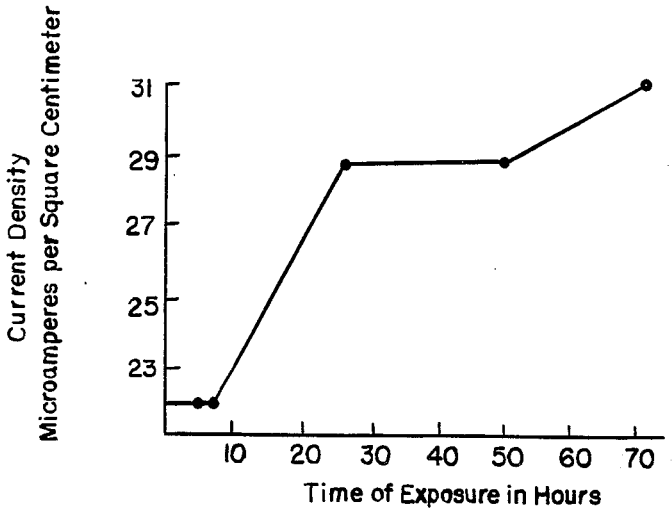
FIG. 6 is a graph of current density versus time for an 0.86% zinc alloy.
Figure 7:
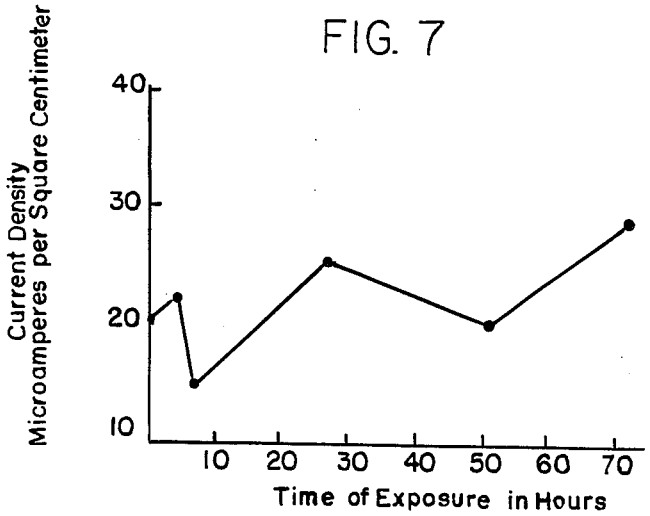
FIG. 7 is a graph of current density versus time for a 1.16% zinc alloy.

FIGS. 6 through 12 show plots of current density versus exposure time for couples of various experimental alloy materials and 8007 and 7072 control alloy, all coupled to the 1235 tube alloy. For example, FIG. 6 shows the data for the new alloy composition containing 0.86% of zinc. It indicates that a positive protective current was being provided to the 1235 alloy tube throughout the 72-hour test period.

Figure 8:
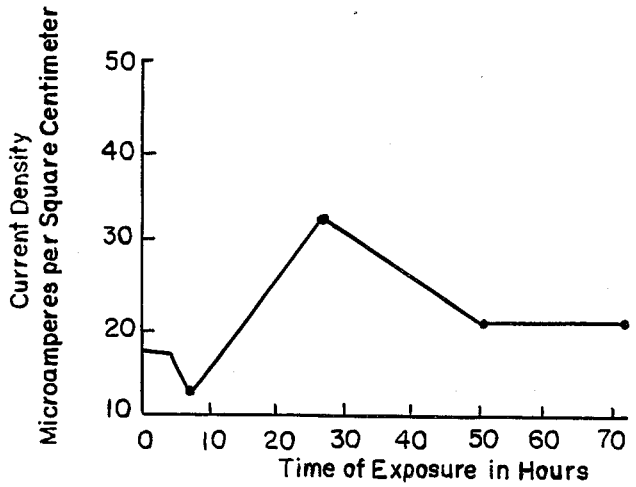
FIG. 8 is a graph of current density versus time for a 1.38% zinc alloy.
Figure 9:
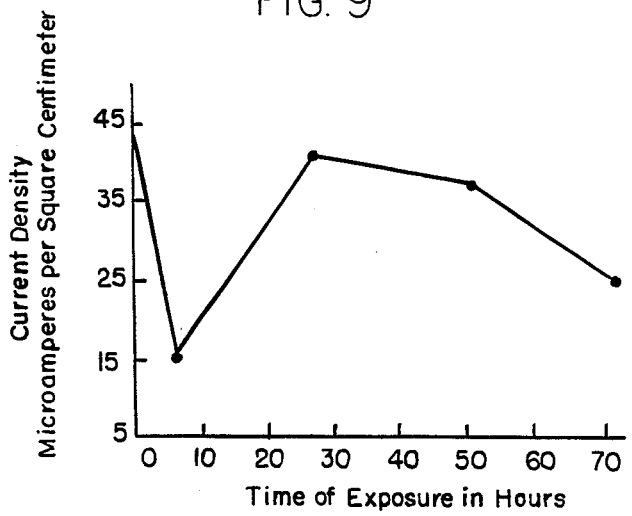
FIG. 9 is a graph of current density versus time for a 2.0% zinc alloy.
Figure 10:
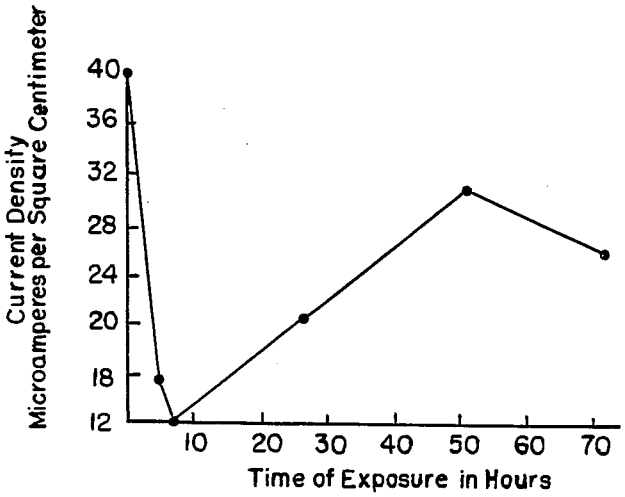
FIG. 10 is a graph of current density versus time for a 2.48% zinc alloy.
Figure 11:
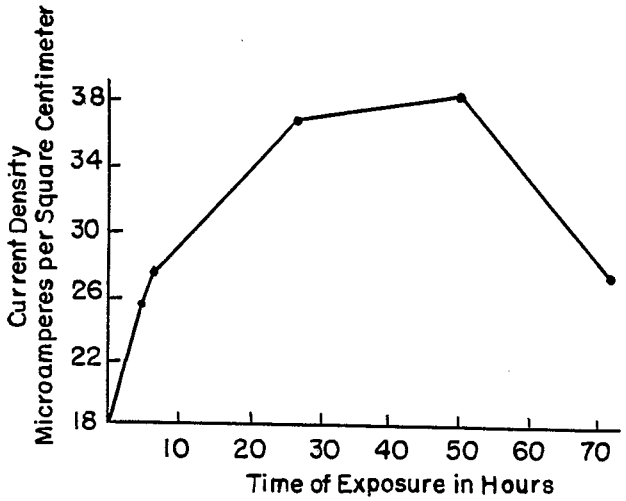
FIG. 11 is a graph of current density versus time for a 7072 alloy.
Figure 12:
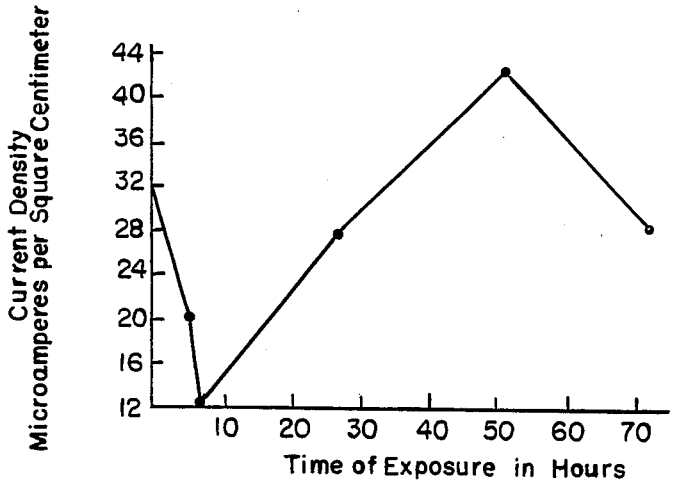
FIG. 12 is a graph of current density versus time for a 8007 alloy.

In contrast, in the previous run of FIG. 3 with 0.82% of zinc, the positive protection current was available for about 10 hours out of the 60-hour test period. FIG. 8 shows the results for a 1.38% zinc alloy; FIG. 9 a 2.0% alloy; FIG. 10 a 2.48% alloy. All the new alloy materials (which included the entire range of zinc contents from 0.83% through 2.48% of zinc) showed that protective current was being provided to the 1235 alloy throughout the test period of up to 72 hours. There was very little trend in the effect of the variation in zinc content on the current output.

The control alloys 7072 and 8007 (FIGS. 11 and 12 respectively) also showed positive protective currents throughout the time of test, with current densities spanning similar orders or magnitude as those for the new alloy materials.

Figure 13:
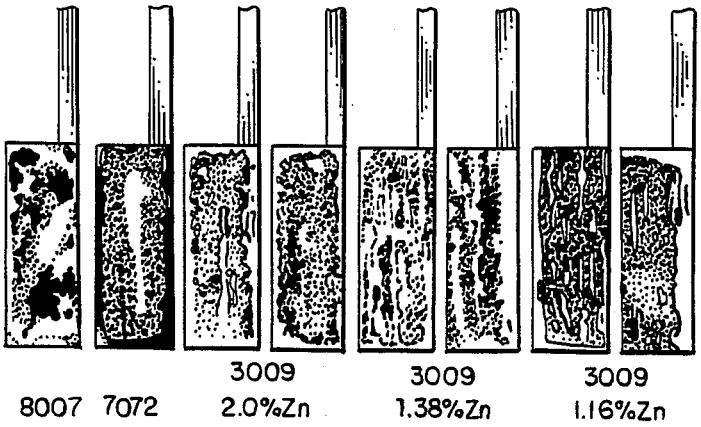
FIG. 13 is a photographic comparison of alloy specimens after galvanic tests.

A direct study of the corrosion resulting from the galvanic test is made from a review of the photographs of the anode samples following the galvanic test on the experimental alloys and is shown in FIG. 13. Inspection of the samples shows progressively more corrosion on the new alloy samples as zinc content increases from 1.16% to 2.0%. However, the corrosion takes the form of a layer type on exfoliation corrosion where entire strata of the metal have been removed from the surface. No perforations of the sheets have developed, whereas the 8007 alloy has been perforated and extensive areas have been completely separated by a generalized intergranular corrosion process. In the case of the 7072 alloy specimen, the edges, where the masking material was undercut, show extensive crevice corrosion which has consumed the entire thickness of the sheet around the edges.

Metallographic sectioning through the specimens was carried out. Photographs were taken at 500X magnification on the most severely corroded parts of the cross sections. Each new alloy shows varying degrees of exfoliation corrosion, whereas the 7072 and 8007 control specimens show more or less directionless intergranular corrosion. The intergranular corrosion on the control alloys perforates the sheets causing general attrition of the metal, whereas the exfoliation is less damaging in the case of the new alloys containing zinc.

The specific composition of the present alloy including the amount of zinc in the alloy may be varied. It has been found that to maintain the benefits of the invention, the amount of zinc may thus be variable from about 0.5% up to an amount of about 2.5% by weight. The preferred nominal composition includes about no less than 1.0% by weight and about no greater than 2.0% by weight zinc with the preferred amount being about 1.7% by weight.

The zinc/aluminum alloy of the present invention provides sacrificial corrosion characteristics and also has structural or mechanical characteristics which will enable manufacture of fins 10 of reduced metal thickness that will maintain sacrificial protection for the aluminum tube 12 in contact with the fins. Of course, the aluminum alloy of the present invention may also be used in other situations where mechanical strength in combination with sacrificial characteristics are desired. Thus, while there has been set forth a preferred embodiment of the invention, it is to be understood that the invention is to be limited only by the following claims and their following equivalents.

What is claimed:

1. An improved aluminum base alloy containing a zinc constituent and especially useful as a sacrificial alloy, said alloy consisting essentially of:

0.6–3.0% by weight silicon, 0.2–1.0% by weight iron,
up to 0.2% by weight copper,
0.8–2.0% by weight manganese,
up to 0.2% by weight magnesium,
0.5–2.5% by weight zinc, and
the balance aluminum.

2. The alloy of claim 1 including up to 0.2% by weight of incidental elements and impurities as other constitutents.

3. The alloy of claim 2 wherein the zinc constitutent is in the range of no less than 1.0% and no greater than 2.0% by weight.

4. The alloy of claim 2 wherein the zinc constitutent is nominally 1.7% by weight.

5. As an article of manufacture, a sacrificial aluminum base material comprising an alloy in the form of a formed part, said alloy consisting essentially of:
0.6–3.0% by weight silicon,
0.2–1.0% by weight iron,
up to 0.2% by weight copper,
0.8–2.0% by weight manganese,
up to 0.2% by weight magnesium,
0.5–2.5% by weight zinc, and
the balance aluminum.

6. The article of claim 5 in combination with a member formed primarily from aluminum which member is to be protected, said article being in physical contact with the member.

7. The article of claim 6 including up to 0.2% by weight incidental elements and impurities as other constituents.

8. An improved aluminum base alloy containing a zinc constituent and especially useful as a sacrificial alloy, said alloy consisting essentially of:
0.6–3.0% by weight silicon,
0.2–2.0% by weight iron,
up to 0.2% by weight copper,
0.8–2.0% by weight manganese,
up to 0.2% by weight magnesium,
no less than 1.0% by weight and no greater than 2.0% by weight zinc, and
the balance aluminum.

9. As an article of manufacture, a sacrificial aluminum base material comprising an alloy in the form of a formed part, said alloy consisting essentially of:
0.6–3.0% by weight silicon,
0.2–1.0% by weight iron,
up to 0.2% by weight copper,
0.8–2.0% by weight manganese,
up to 0.2% by weight magnesium,
no less than 1.0% by weight and no greater than 2.0% by weight zinc, and
the balance aluminum.

* * * * *